US011449089B1

(12) United States Patent
Seeger

(10) Patent No.: US 11,449,089 B1
(45) Date of Patent: Sep. 20, 2022

(54) JOYSTICK HAVING INCREASED CONTROL FUNCTIONALITY

(71) Applicants: ZOOMLION Heavy Industry NA, Inc., Yorkville, WI (US); ZOOMLION Heavy Industry Science and Technology Co. Ltd., Changsha (CN)

(72) Inventor: Matthew P. Seeger, Franksville, WI (US)

(73) Assignees: ZOOMLION HEAVY INDUSTRY NA, INC., Yorkville, WI (US); ZOOMLION HEAVY INDUSTRY SCIENCE AND TECHNOLOGY CO., LTD, Changsha (CN)

( * ) Notice: Subject to any disclaimer, the term of this patent is extended or adjusted under 35 U.S.C. 154(b) by 0 days.

(21) Appl. No.: 17/404,262

(22) Filed: Aug. 17, 2021

(51) Int. Cl.
*G05G 9/04* (2006.01)
*E02F 9/20* (2006.01)
*G05G 9/047* (2006.01)

(52) U.S. Cl.
CPC ..... *G05G 9/047* (2013.01); *E02F 9/2004* (2013.01); *G05G 2009/04748* (2013.01); *G05G 2009/04781* (2013.01)

(58) Field of Classification Search
CPC ..... G05G 9/047; G05G 9/04737; G05G 2009/04748; G05G 2009/04774; G05G 2009/04781; E02F 9/2004; H01H 25/04; H01H 2025/043; H01H 2025/045; B60K 2026/029
See application file for complete search history.

(56) References Cited

U.S. PATENT DOCUMENTS 3,028,126 A * 4/1962 Holleman ..... G05G 1/62 244/236
3,260,826 A * 7/1966 Johnson ..... B64C 39/026 338/68
5,193,963 A * 3/1993 McAffee ..... B25J 3/04 414/7
5,223,776 A 6/1993 Radke et al.
(Continued)

FOREIGN PATENT DOCUMENTS

DE 19802983 A1 * 7/1999 ..... G05G 9/047
DE 102014012282 A1 * 2/2016 ..... E02F 9/2004
(Continued)

*Primary Examiner* — Adam D Rogers
(74) *Attorney, Agent, or Firm* — Donald J. Ersler

(57) ABSTRACT

A joystick having increased control functionality preferably includes an industrial joystick base and a rotary upper handle. The rotary upper handle preferably includes an outer base ring, a rotatable ring, a position sensor and a base portion. The outer base ring extends upward from the base portion. The base portion extends from the industrial joystick base. The rotatable ring is rotatably retained in an inner perimeter of the outer base ring. The position sensor is retained in a sensor cavity formed in an inner perimeter of the outer base ring. The rotatable ring preferably includes a ring portion, a rotatable cylinder bar and a compression spring. A center contact and a peripheral contact are retained in an end of the rotatable cylinder bar and make contact with the position sensor. The motion of the rotatable ring and the rotatable cylinder bar are sent to a ring controller for processing.

19 Claims, 5 Drawing Sheets

(56) References Cited

U.S. PATENT DOCUMENTS

| | | | | |
|---|---|---|---|---|
| 5,619,195 | A * | 4/1997 | Allen | G05G 9/047 341/20 |
| 6,880,855 | B2 * | 4/2005 | Chernoff | B60W 30/18181 74/552 |
| 7,113,836 | B2 | 9/2006 | Hornig | |
| 7,148,819 | B2 * | 12/2006 | Kim | G05G 9/04737 341/20 |
| 2015/0060185 | A1 * | 3/2015 | Feguri | B62D 1/12 180/333 |

FOREIGN PATENT DOCUMENTS

| | | | | |
|---|---|---|---|---|
| DE | 102014012283 | A1 * | 2/2016 | E02F 3/43 |
| DE | 102014012284 | A1 * | 2/2016 | E02F 3/43 |
| GB | 2283079 | A * | 4/1995 | G05G 9/047 |

* cited by examiner

JOYSTICK HAVING INCREASED CONTROL FUNCTIONALITY

BACKGROUND OF THE INVENTION

1. Field of the Invention

The present invention relates generally to heavy equipment and more specifically to a joystick having increased control functionality, which allows more functions to be performed by a single hand.

2. Discussion of the Prior Art

It appears that the prior art does not disclose a joystick having increased control functionality, which allows more functions to be performed by one hand. U.S. Pat. No. 5,223,776 to Radke et al. discloses a six-degree virtual pivot controller. U.S. Pat. No. 7,113,836 to Hornig discloses a control device for maneuvering an apparatus.

Accordingly, there is clearly felt need in the art for a joystick having increased control functionality, which includes a unique moving structure, and which allows more functions to be performed by a single hand.

SUMMARY OF THE INVENTION

The present invention provides a joystick having increased control functionality, which allows more functions to be performed by a single hand. The joystick having increased control functionality (improved joystick) preferably includes a state-of-the art joystick base for heavy equipment (industrial joystick base), which includes two axis functionality and a rotary upper handle. The rotary upper handle preferably includes an outer base ring, a rotatable ring, a position sensor and a base portion. The base portion extends downward from a bottom of the outer base ring. A bottom of the base portion is engaged with a top of the industrial joystick base. The detachable ring is secured to one side of the outer base ring with any suitable attachment method, such as fasteners, a bonding agent, a snap arrangement or any other suitable attachment method. The outer base ring preferably includes a detachable retention ring. A base groove is formed in the outer base ring and a ring groove is formed in the detachable retention ring. The base and grooves prevent axial movement of the rotatable ring relative to the outer base ring. The detachable retention ring is secured to one side of the outer base ring with any suitable attachment method, such as fasteners, a bonding agent, a snap arrangement or any other suitable attachment method.

A sensor cavity is formed in an inner perimeter of the outer base ring, below the grooves for receiving the rotatable ring. The position sensor is preferably a PCAP (projective capacitive) touch sensor. However, other types of sensors may also be used. The rotatable ring preferably includes a ring portion and a rotatable cylinder bar. The ring portion preferably includes two halves. A pair of opposing bosses preferably extend inward from an inner perimeter of the ring portion. A through hole is formed through the pair of opposing bosses. The rotatable cylinder bar includes an inner diameter. The inner diameter of the rotatable cylinder bar is sized to rotatably receive an outer diameter of the pair of opposing bosses. A contact plug is preferably pressed into the inner diameter of the rotatable cylinder bar. However, the contact plug may be molded into the inner perimeter of the rotatable cylinder bar. The contact plug includes a biased center conductive contact and a biased peripheral conductive contact. The heights of the center and peripheral conductive contacts are equal. It is preferable to use a compression spring to bias the center and peripheral conductive contacts outward to contact the position sensor. The ring portion with the rotatable cylinder bar retained therein is inserted into the inner perimeter of the outer base ring. The detachable ring is secured to one side of the outer base ring. The center and peripheral conductive contacts must make physical contact with the position sensor.

The wiring from the position sensor may be run down a side of the outer base ring or molded into rotary upper handle. The wiring is connected to a suitable ring controller for determining the location of the rotatable cylinder bar and the rotatable ring. The position sensor includes a grid arrangement, which allows a rotational position and an angular position of the two-spring loaded conductive contacts to be determined. When the rotatable cylinder bar is rotated in either a clockwise or counterclockwise direction, the center conductive contact will remain relatively stationary, while the peripheral conductive contact will rotate about the center conductive contact. The rotational motion of the rotatable cylinder bar will be picked-up by the ring controller and could be used to control curling or dumping of a bucket. When the rotatable ring is rotated in either a clockwise or counterclockwise direction the angular motion will be picked-up by the ring controller and could be used to control boom-up or boom-down.

Accordingly, it is an object of the present invention to provide a joystick having increased control functionality having a unique moving structure, which allows more functions to be performed by one hand.

These and additional objects, advantages, features and benefits of the present invention will become apparent from the following specification.

DETAILED DESCRIPTION OF THE PREFERRED EMBODIMENTS

Figure 1:
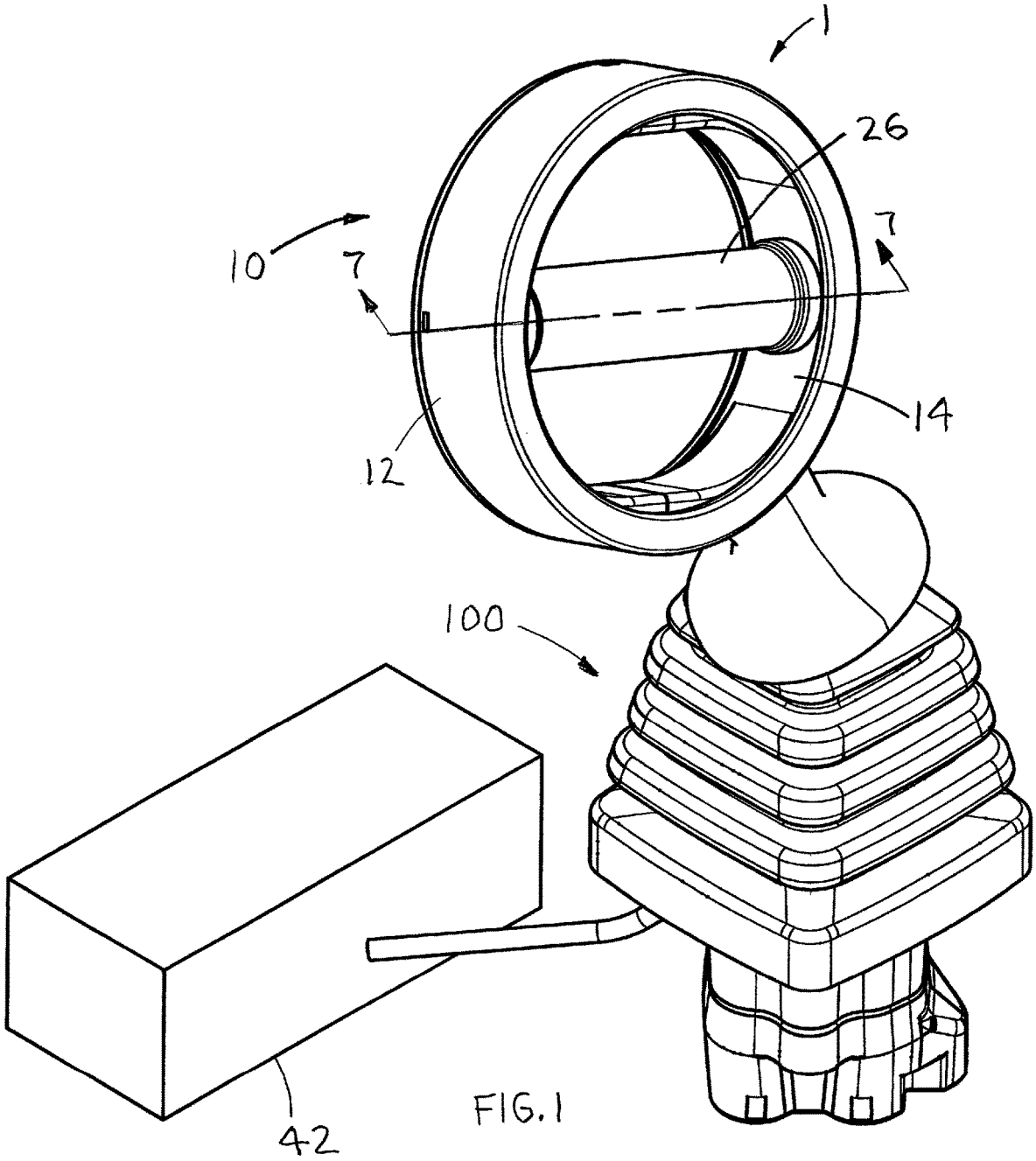
FIG. 1 is a perspective view of an improved joystick in accordance with the present invention.
Figure 2:
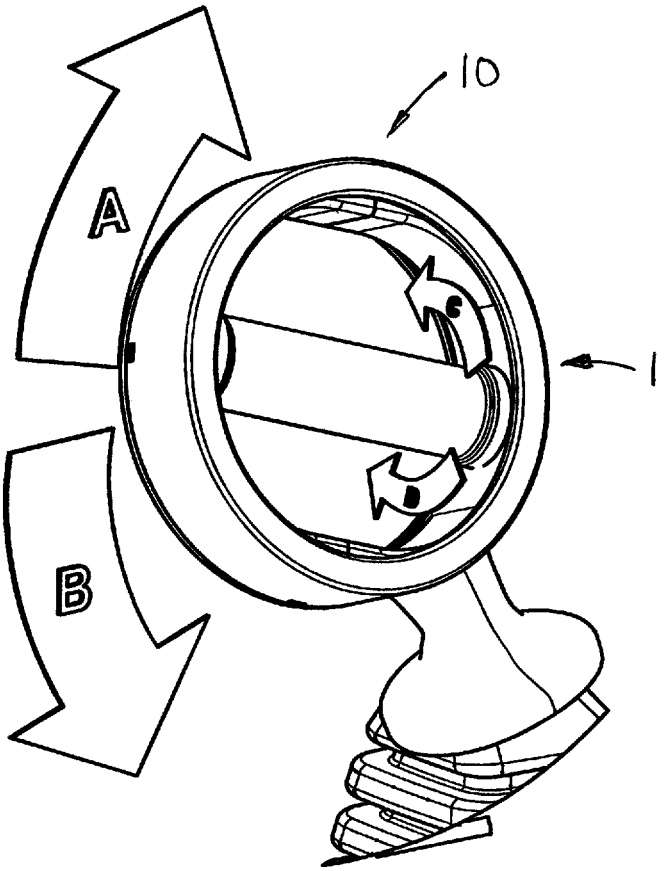
FIG. 2 is a perspective view of an improved joystick illustrating rotation of a ring portion and a rotatable cylinder bar in accordance with the present invention.
Figure 3:
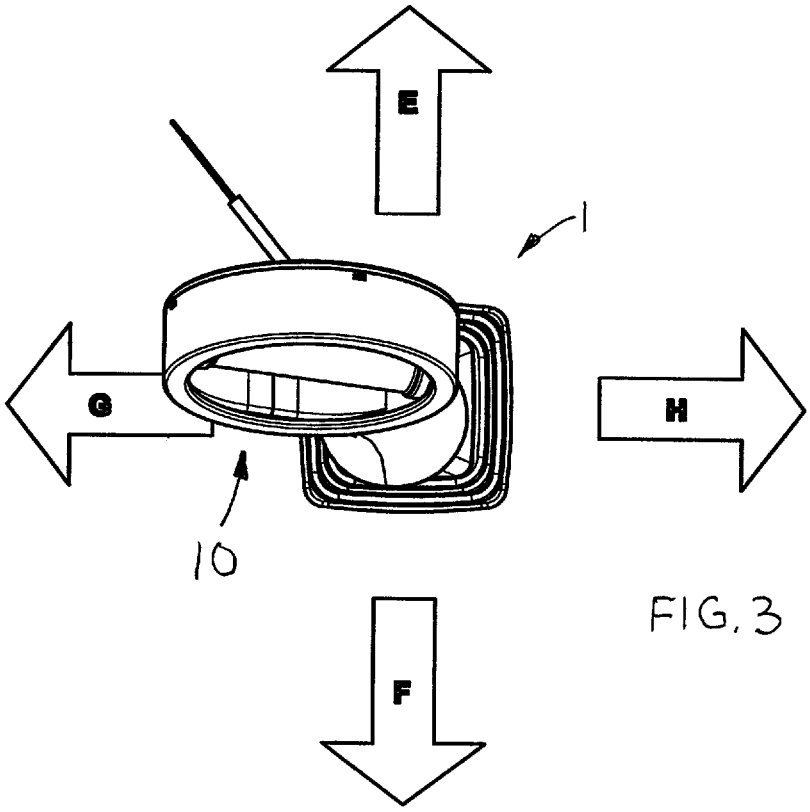
FIG. 3 is a perspective view of an improved joystick illustrating x-axis motion and y-axis motion of a rotary upper handle in accordance with the present invention.
Figure 4:
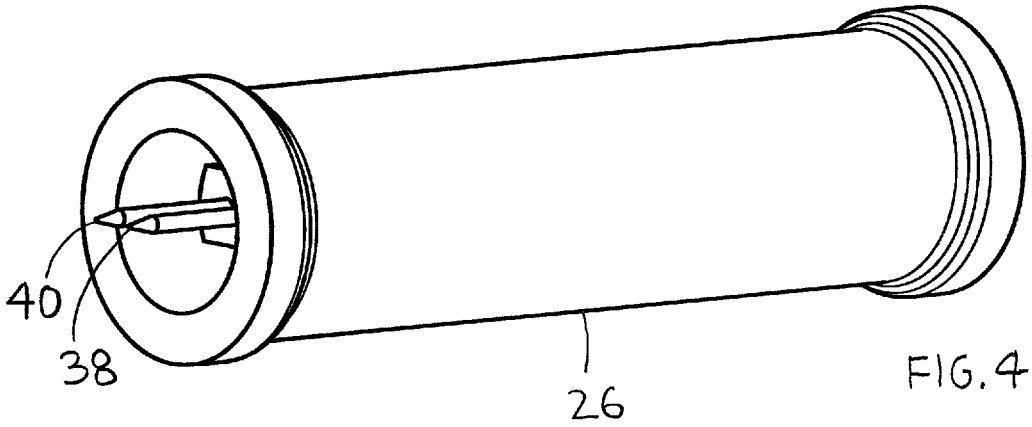
FIG. 4 is a perspective view of a rotatable cylinder bar of an improved joystick in accordance with the present invention.
Figure 5:
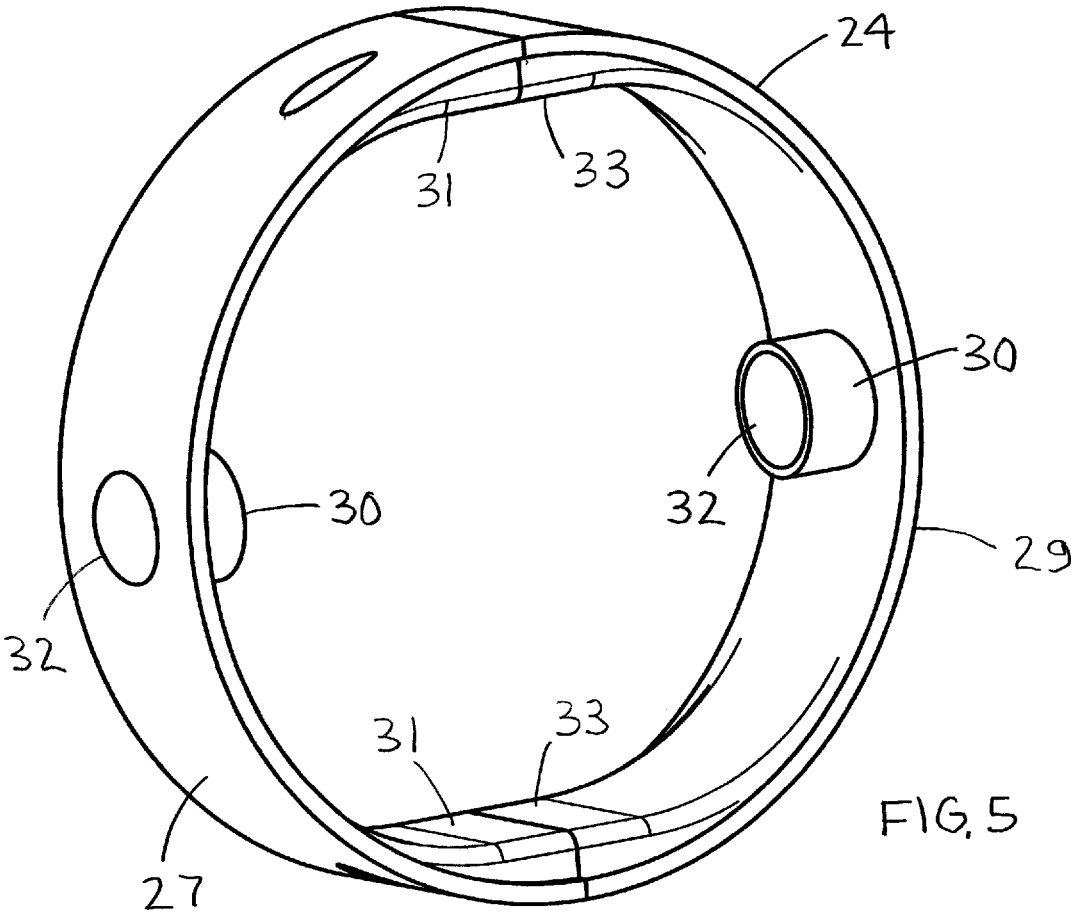
FIG. 5 is a perspective view of a ring portion of an improved joystick in accordance with the present invention.
Figure 6:
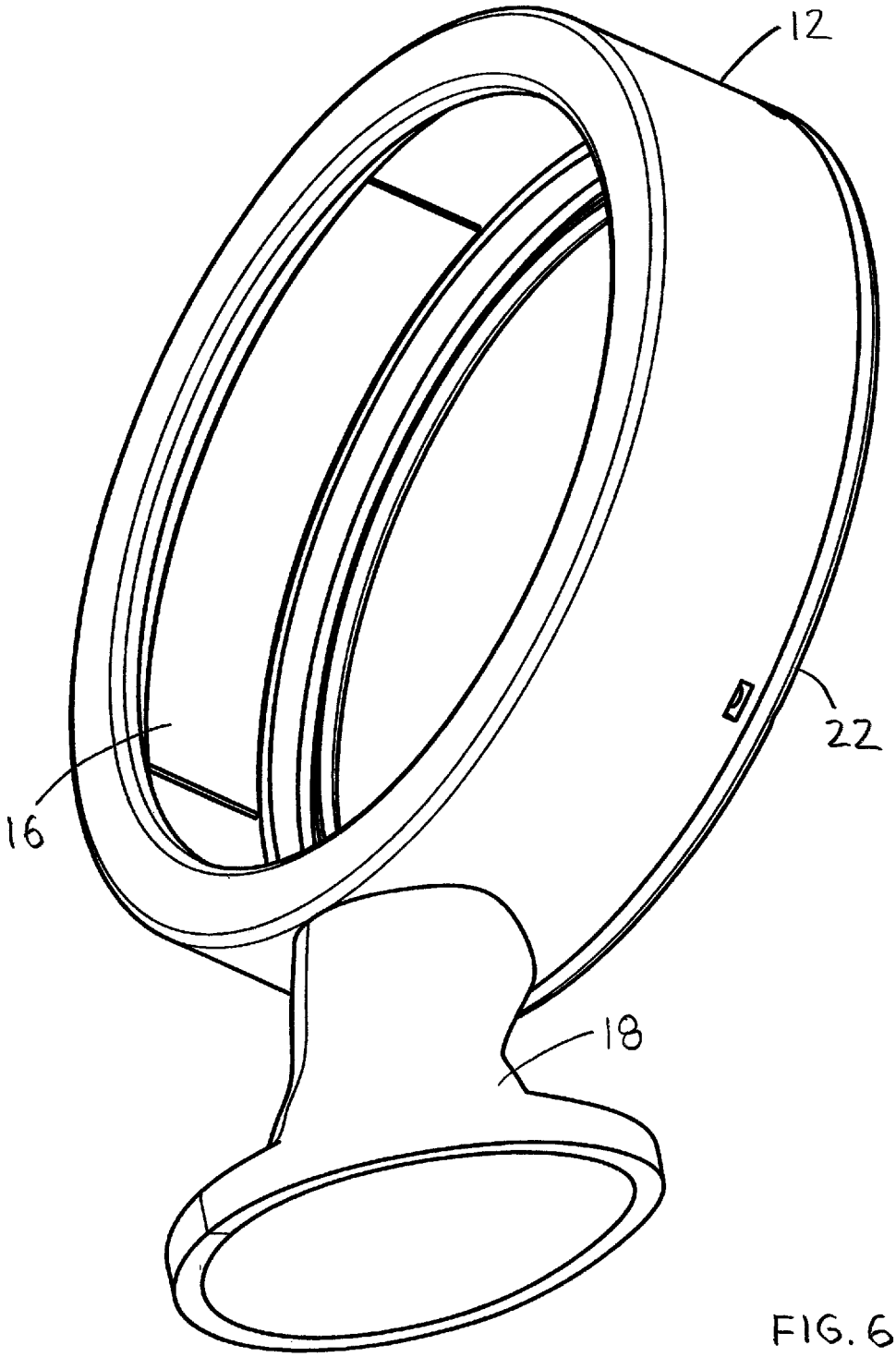
FIG. 6 is a perspective view of an outer base ring of an improved joystick in accordance with the present invention.
Figure 7:
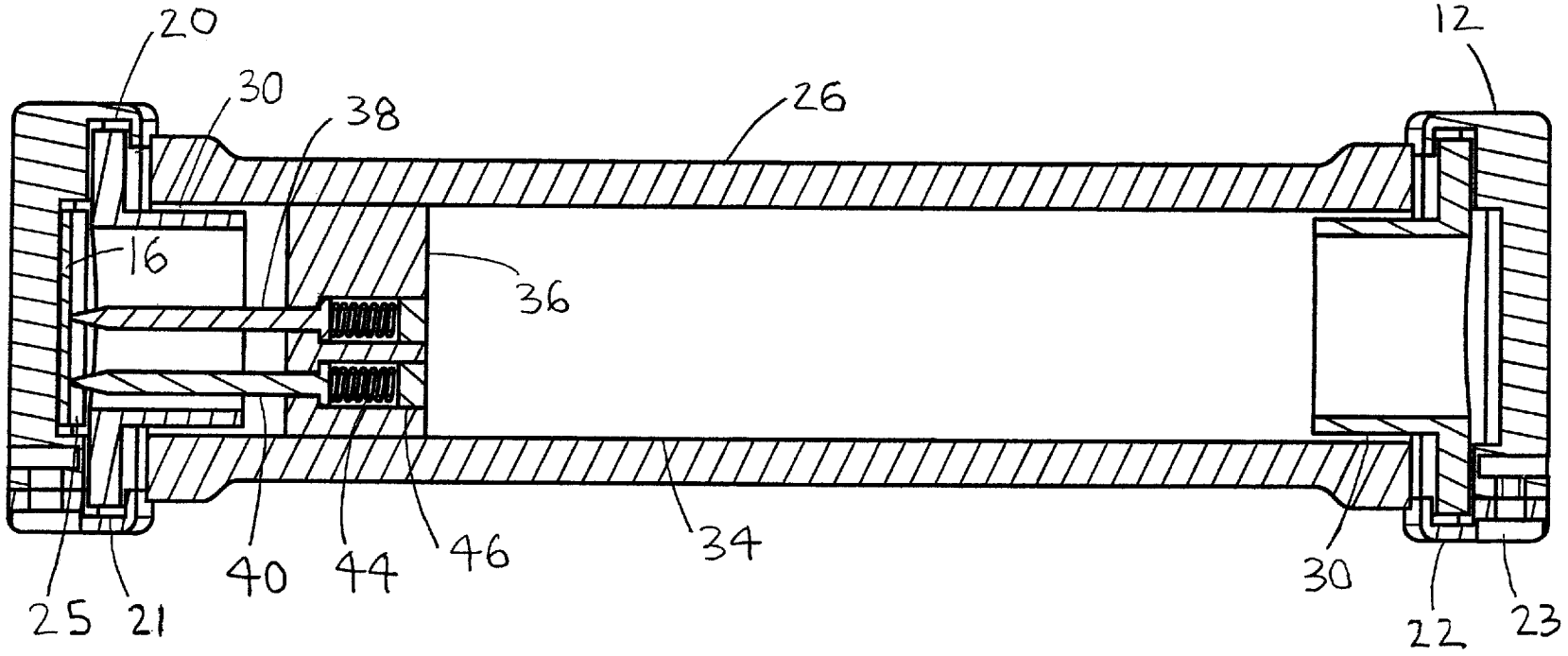
FIG. 7 is a cross-sectional view of a rotary upper handle of an improved joystick in accordance with the present invention.

With reference now to the drawings, and particularly to FIG. 1, there is shown a perspective view of an improved joystick 1. With reference to FIGS. 2-3, the improved joystick 1 preferably includes a state-of-the art joystick base for heavy equipment (industrial joystick base) 100 with x-axis and y-axis movement, and a rotary upper handle 10. There are numerous ways in the art of implementing a two-axis joystick. Therefore, a further explanation of the operation of a two-axis joystick is not necessary.

With reference to FIGS. 4-7, the rotary upper handle 10 preferably includes an outer base ring 12, a rotatable ring 14, a position sensor 16 and a base portion 18. A bottom of the base portion 18 extends from a top of the industrial joystick base 100. The outer base ring 12 extends upward from a top of the base portion 18. The rotatable ring 14 is rotatably retained in an inner perimeter of the outer base ring 12. The outer base ring 12 preferably includes a detachable retention ring 22. A base groove 20 is formed in the outer base ring 12 and a ring groove 25 is formed in the detachable retention ring 22. The base and ring grooves 20, 25 prevent axial movement of the rotatable ring 14 relative to the outer base ring. The detachable retention ring 22 is secured to one side of the outer base ring with any suitable attachment device, such as a plurality of fasteners 23, a bonding agent, snap arrangement or any other suitable attachment method.

A sensor cavity 25 is formed in an inner perimeter of the outer base ring 12 and below a bottom of the pair of opposing grooves 20 for receiving the position sensor 16. The position sensor 16 is preferably a PCAP (projective capacitive) touch sensor. However, other types of sensors may also be used. The position sensor 16 must be curved along a lengthwise axis or be flexible to conform to an inner perimeter of the sensor cavity 25. The rotatable ring 14 preferably includes a ring portion 24 and a rotatable cylinder bar 26. A pair of opposing bosses 30 preferably extend inward from an inner perimeter of the ring portion 24. A through hole 32 is formed through the pair of opposing bosses 30.

The ring portion 24 preferably includes first and second halves 27, 29. Each end of the first half 27 includes an attachment area 31 for attaching an opposing half. Each end of the second half 29 includes an attachment area 33 for attaching an opposing half. The first and second halves 27, 29 may be attached to each other with fasteners, adhesive, snaps or any other suitable attachment method. A pair of opposing bosses 30 preferably extend inward from an inner perimeter of the ring portion 24. A through hole 32 is formed through the pair of opposing bosses 30. The rotatable cylinder bar 26 includes an inner diameter 34. The inner diameter 34 of the rotatable cylinder bar 26 is sized to rotatably receive an outer diameter of the pair of opposing bosses 30. A contact plug 36 is preferably pressed into the inner diameter 34 of the rotatable cylinder bar 26. However, the contact plug 36 may be molded into the inner perimeter of the rotatable cylinder bar 26. The contact plug 36 preferably includes a biased center conductive contact 38 and a biased peripheral conductive contact 40. However, the contact plug 36 may only include a center conductive contact 38, if an electrical output from the rotatable cylinder bar 26 is not needed. A compression spring 44 and set screw 46 are preferably used to bias the center and peripheral conductive contacts 38, 40 against the position sensor 16. The heights of the center and peripheral conductive contacts 38, 40 are equal. The center and peripheral contacts 38, 40 extend beyond an outer perimeter of the rotatable ring 14.

The ring portion 24 with the rotatable cylinder bar 26 retained therein is inserted into the inner perimeter of the outer base ring 12. The detachable ring 22 is secured to one side of the outer base ring 12 with the plurality of fasteners 23. Sensor wiring (not shown) from the position sensor 16 is run down a side of the outer base ring 12 or molded into the rotary upper handle 10. However, the ring portion 24 may not rotate relative to the outer base ring 12 for some applications. The rotatable cylinder bar 26 would rotate with the center and peripheral conductive contacts 38, 40. The sensor wiring is connected to a suitable ring controller 42 for determining the location of the rotatable cylinder bar 26 and the rotatable ring portion 24. The position sensor 16 includes a grid arrangement, which allows a rotational position and an angular position of the ring portion 24 and the rotatable cylinder bar 26 to be determined. When the rotatable cylinder bar 26 is rotated in either a clockwise or counterclockwise direction, the center conductive contact 38 will remain relatively stationary, while the peripheral conductive contact 40 will rotate about the center conductive contact 38. The rotational motion of the rotatable cylinder bar 26 will be picked-up by the ring controller 42 and could be used to control curling or dumping of a bucket. When the rotatable ring 14 is rotated in either a clockwise or counterclockwise direction the angular motion will be processed by the ring controller 42 and could be used to control boom-up or boom-down. Movement of the rotary upper handle 10 in the X-axis and the Y-axis will also be processed by the ring controller 42 and used to operate the appropriate attachment. Buttons, toggle switches, thumb wheels and other control devices may also be added to the rotary upper handle 10.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A joystick having increased control functionality, comprising:

a rotary handle includes an outer base ring;

a position sensor is located in an inner perimeter of said outer base ring; and a rotatable ring is rotatably retained in an inner perimeter of said outer base ring, said rotatable ring includes a ring portion, at least one conductive contact extends beyond an outer perimeter of said rotatable ring, said position sensor is located between an outer perimeter of said ring portion and said outer base ring, said at least one conductive contact is biased to make contact with said position sensor, wherein an output of said position sensor provides a rotational position of said ring portion.

2. The joystick having increased control functionality of claim 1 wherein:

at least one compression spring forces said at least one conductive contact against said position sensor.

3. The joystick having increased control functionality of claim 1 wherein:

a base portion extends from a bottom of said rotary handle, said base portion includes x-axis and y-axis positional output.

4. The joystick having increased control functionality of claim 1 wherein:

a cylinder bar extends across an inner perimeter of said ring portion.

5. The joystick having increased control functionality of claim 1 wherein:

said ring portion includes a first half and a second half.

6. The joystick having increased control functionality of claim 1, further comprising:

a retention ring includes a groove for retaining an edge of said ring portion, said retention ring is removably attachable to one side of said ring portion, a second groove is formed in an inner surface of an opposing side of said outer base ring, said second groove is sized to receive an opposing edge of said ring portion.

7. The joystick having increased control functionality of claim 1 wherein:

said position sensor is flexible or is curved along a lengthwise axis.

8. A joystick having increased control functionality, comprising:

a rotary handle includes an outer base ring;

a position sensor is located in an inner perimeter of said outer base ring; and a ring is retained in an inner perimeter of said outer base ring, said ring includes a ring portion;

a rotatable cylinder bar includes a pair of conductive contacts formed in an end thereof, said rotatable cylinder bar rotates relative to said ring, said position sensor is located between an outer perimeter of said ring portion and said outer base ring, said pair of conductive contacts are biased to make contact with said position sensor, wherein a movement of one of said pair of conductive contacts is measured relative to a second one of said pair of conductive contacts to provide a rotational position of said rotatable cylinder bar.

9. The joystick having increased control functionality of claim 8 wherein:

said ring portion includes a pair of opposing bosses that extend inward from an inner perimeter of said ring portion, an inner perimeter of said rotatable cylinder bar is sized to rotatably receive an outer perimeter of said pair of opposing bosses.

10. The joystick having increased control functionality of claim 9 wherein:

said ring portion includes a first half and a second half.

11. The joystick having increased control functionality of claim 8 wherein:

said pair of conductive contacts include a center conductive contact located on a centerline of said rotatable cylinder bar and a peripheral conductive contact located adjacent an outer perimeter of said rotatable cylinder bar.

12. The joystick having increased control functionality of claim 8 wherein:

at least one compression spring forces said pair of conductive contacts against said position sensor.

13. The joystick having increased control functionality of claim 8, further comprising:

a retention ring includes a groove for retaining an edge of said ring portion, said retention ring is removably attachable to one side of said ring portion, a second groove is formed in an inner surface of an opposing side of said outer base ring, said second groove is sized to receive an opposing edge of said ring portion.

14. A joystick having increased control functionality, comprising:

a rotary handle includes an outer base ring;

a position sensor is located in an inner perimeter of said outer base ring;

a rotatable ring is rotatably retained in an inner perimeter of said outer base ring, said rotatable ring includes a ring portion and a rotatable cylinder bar, said rotatable cylinder bar is rotatably retained across a diameter of said ring portion, a pair of conductive contacts are formed in an end of said rotatable cylinder bar, said position sensor is located between an outer perimeter of said ring portion and said outer base ring, said pair of conductive contacts are biased to make contact with said position sensor, wherein an output of said position sensor provides a rotational position of said rotatable cylinder bar and said ring portion.

15. The joystick having increased control functionality of claim 14 wherein:

a ring controller for receiving output from said position sensor for instruction of implement movement.

16. The joystick having increased control functionality of claim 14 wherein:

said ring portion includes a pair of opposing bosses that extend inward from an inner perimeter of said ring portion, an inner perimeter of said rotatable cylinder bar is sized to rotatably receive an outer perimeter of said pair of opposing bosses.

17. The joystick having increased control functionality of claim 14 wherein:

said pair of conductive contacts include a center conductive contact located on a centerline of said rotatable cylinder bar and a peripheral conductive contact located adjacent an outer perimeter of said rotatable cylinder bar.

18. The joystick having increased control functionality of claim 14 wherein:

a pair of compression springs force said pair of conductive contacts against said position sensor.

19. The joystick having increased control functionality of claim 14, further comprising:

a retention ring includes a groove for retaining an edge of said ring portion, said retention ring is removably attachable to one side of said ring portion, a second groove is formed in an inner surface of an opposing side of said outer base ring, said second groove is sized to receive an opposing edge of said ring portion.

* * * * *